US007802326B2

(12) United States Patent
Kempter et al.

(10) Patent No.: US 7,802,326 B2
(45) Date of Patent: Sep. 28, 2010

(54) BATH TUB LIFTER

(75) Inventors: Robert Kempter, Isny (DE); Michael Kimmerle, Leutkirch (DE); Martin Wirth, Isny (DE)

(73) Assignee: Aquatec GmbH, Isny (DE)

( * ) Notice: Subject to any disclaimer, the term of this patent is extended or adjusted under 35 U.S.C. 154(b) by 1111 days.

(21) Appl. No.: 11/485,776

(22) Filed: Jul. 13, 2006

(65) Prior Publication Data

US 2007/0011804 A1 Jan. 18, 2007

(30) Foreign Application Priority Data

Jul. 14, 2005 (DE) ..... 10 2005 033 534

(51) Int. Cl.
*A47K 3/02* (2006.01)

(52) U.S. Cl. ..... 4/560.1

(58) Field of Classification Search ..... 4/560.1, 4/564.1–566.1

See application file for complete search history.

(56) References Cited

U.S. PATENT DOCUMENTS 5,708,992 A * 1/1998 Gobbers et al. ..... 4/565.1
5,978,984 A * 11/1999 Gobbers et al. ..... 4/565.1

FOREIGN PATENT DOCUMENTS

DE 297 04 769 U 1 6/1997
DE 198 48 923 C 2 4/1999
DE 198 39 176 A 1 3/2000
EP 0 853 936 A2 7/1998
EP 0853 936 B1 6/2002

OTHER PUBLICATIONS

International Search Report for International Patent Application No. EP 06 11 6750 mailed Oct. 9, 2006 (with English language search report form).
Deutsche Patent- und Markenamt Seach Report for Patent Application No. DE 10 2005 033 534.9.

* cited by examiner

*Primary Examiner*—Huyen Le
(74) *Attorney, Agent, or Firm*—RatnerPrestia

(57) ABSTRACT

A bath tub lifter for seniors or disabled persons comprises a frame to rest on a portion of a bath tub, a seat plate and a backrest in connection therewith, a lifting means for adjusting the height of the seat plate and the backrest between a lowermost and an uppermost end position, the lifting means comprising a driving means mounted to the backrest and a telescopic lifting tube to be actuated by the driving means, a spindle base in connection with the lifting tube for providing support against the frame, and an automatic lock-release device coupling the backrest and the seat plate above the lowermost end position and releasing the backrest and the seat plate in the lowermost end position, the lock-release device comprising at least one lock bolt movably held at the backrest for coupling the backrest and the seat plate above the lowermost end position, and at least one sliding guide formed at the seat plate for actuating the at least one lock bolt.

10 Claims, 3 Drawing Sheets

BATH TUB LIFTER

FIELD OF THE INVENTION

The invention relates to a bath tub lifter for seniors or disabled persons. The invention further relates to a lock-release device for a bath tub lifter for seniors or disabled persons.

BACKGROUND OF THE INVENTION

Bath tub lifters are, for example, employed in nursing homes and hospitals for facilitating the bathing or washing of invalid, disabled or elderly persons in bath tubs or the like. It is a disadvantage of these known bath tub lifters that often the backrest and the seat plate can not be separated or only be separated with some efforts. These bath tub lifters are therefore often transported or removed from the bath tub as a whole with great physical effort.

SUMMARY OF THE INVENTION

Starting from this situation, the underlying invention is a bath tub lifter for seniors or disabled persons such that the removal or transport of a bath tub lifter is possible without great effort. Furthermore, a lock-release device is provided for a bath tub lifter the function of which is particularly secure and which has an extremely simple design.

One exemplary embodiment of the bath tub lifter according to the present invention comprises

- a floor frame to rest on the floor of a bath tub,
- a seat plate and a backrest in connection therewith,
- a lifting means for adjusting the height of the seat plate and the backrest between a lowermost and an uppermost end position, the lifting means comprising:
  - a driving means mounted to the backrest, and
  - a telescopic lifting tube to be actuated by the driving means,
- a spindle base in connection with the lifting tube for providing support against the floor frame, and
- an automatic lock-release device coupling the backrest and the seat plate above the lowermost end position and releasing the backrest and the seat plate in the lowermost end position, the lock-release device comprising:
  - at least one lock bolt movably held at the backrest for coupling the backrest and the seat plate above the lowermost end position, and
  - at least one sliding guide formed at the seat plate for actuating the at least one lock bolt.

That means, if the seat plate and the backrest are driven into the lowermost end position of their travel, the backrest and the seat plate are automatically separated there. This is only performed by their downward movement. Corresponding tools as are required in bath tub lifters known from prior art are not necessary. Accordingly, the backrest with the driving means can be separately removed without any mounting works.

According to an advantageous embodiment, the at least one lock bolt can be moved between a release position and a lock position. In the release position, the backrest and the seat plate are released from one another, while in the lock position they are coupled to one another. The corresponding states are achieved by the respective position of the at least one lock bolt.

It is advantageous for the at least one sliding guide to comprise a support section for coupling the backrest and the seat plate to one another. Advantageously, the at least one sliding guide also comprises a transfer section for actuating the at least one lock bolt. Accordingly, the positions of the at least one lock bolt are achieved by the at least one sliding guide.

Preferably, the transfer section extends diagonally with respect to a vertical line. Due to the diagonal extension of the transfer section, the at least one lock bolt is steadily and slowly transferred between its positions.

According to an advantageous embodiment, the at least one lock bolt has a central longitudinal axis. It is convenient for the at least one lock bolt to comprise an end cooperating with the at least one sliding guide, this end comprising an inclined surface extending diagonally with respect to the central longitudinal axis and a contact surface extending essentially perpendicularly to the central longitudinal axis. Due to the inclined surface, the at least one lock bolt can be again steadily displaced between its positions. In the area of the contact surface, the backrest and the seat plate are coupled to each other.

It is advantageous if a radially projecting securing element is in connection with the at least one lock bolt. This securing element serves as protection from losing the at least one lock bolt.

The object concerning the lock-release device is achieved according to the invention by the lock-release device comprising at least one lock bolt being movable between

- a lock position for coupling a backrest and a seat plate of a bath tub lifter to each other, and
- a release position for releasing the backrest and the seat plate from one another, the at least one lock bolt being automatically actuated by means of a sliding guide.

An external actuation for displacing the at least one lock bolt is consequently not necessary in this case. The lock-release device serves for the connection of the backrest with the seat plate and its release from the seat plate.

BRIEF DESCRIPTION OF THE DRAWINGS

Below, the invention will be described more in detail with reference to a preferred embodiment in connection with the drawing, wherein.

DETAILED DESCRIPTION OF THE INVENTION

Figure 1:
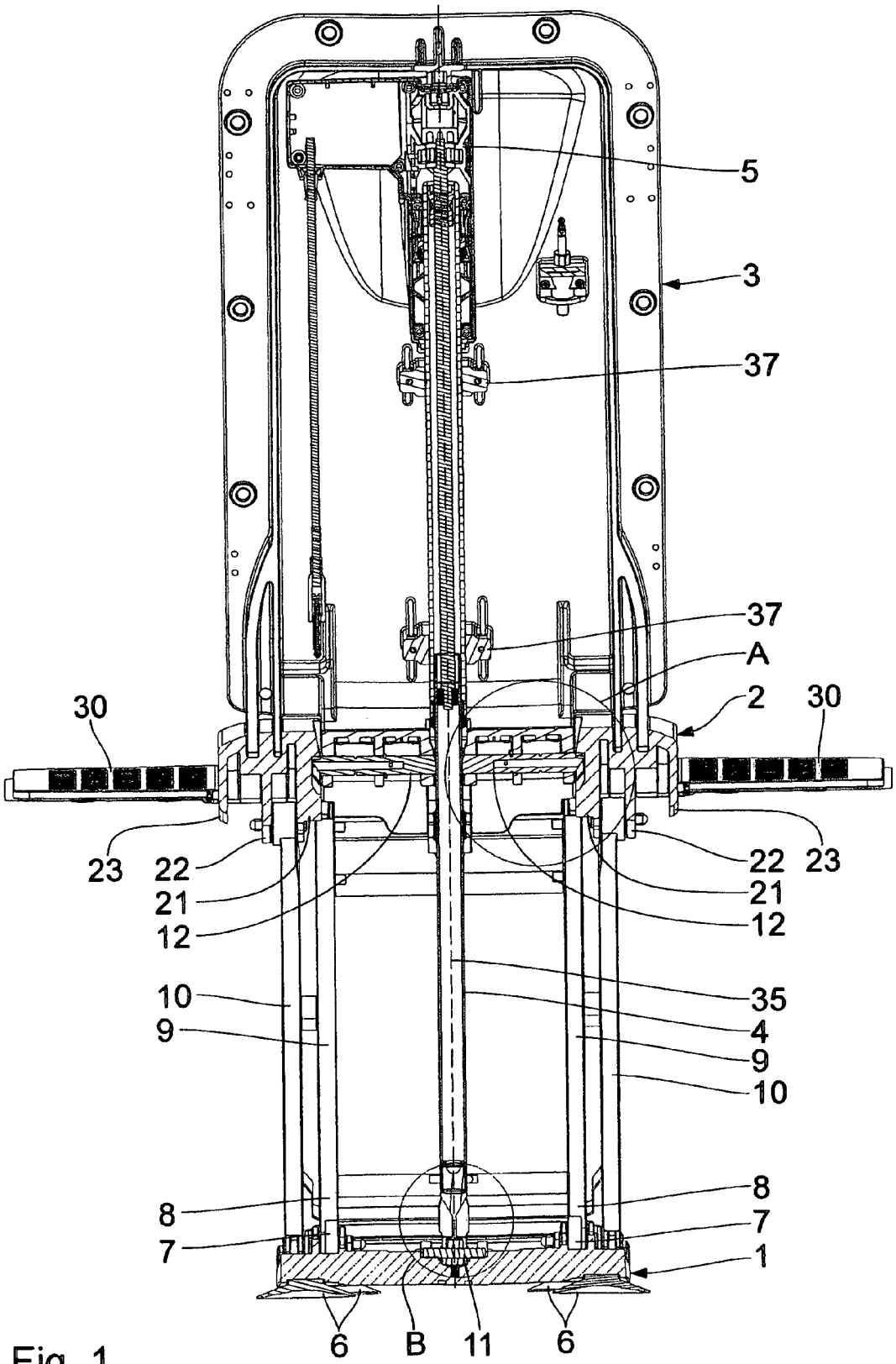
FIG. 1 shows a partially cut section of a bath tub lifter according to the invention from behind.
Figure 2:
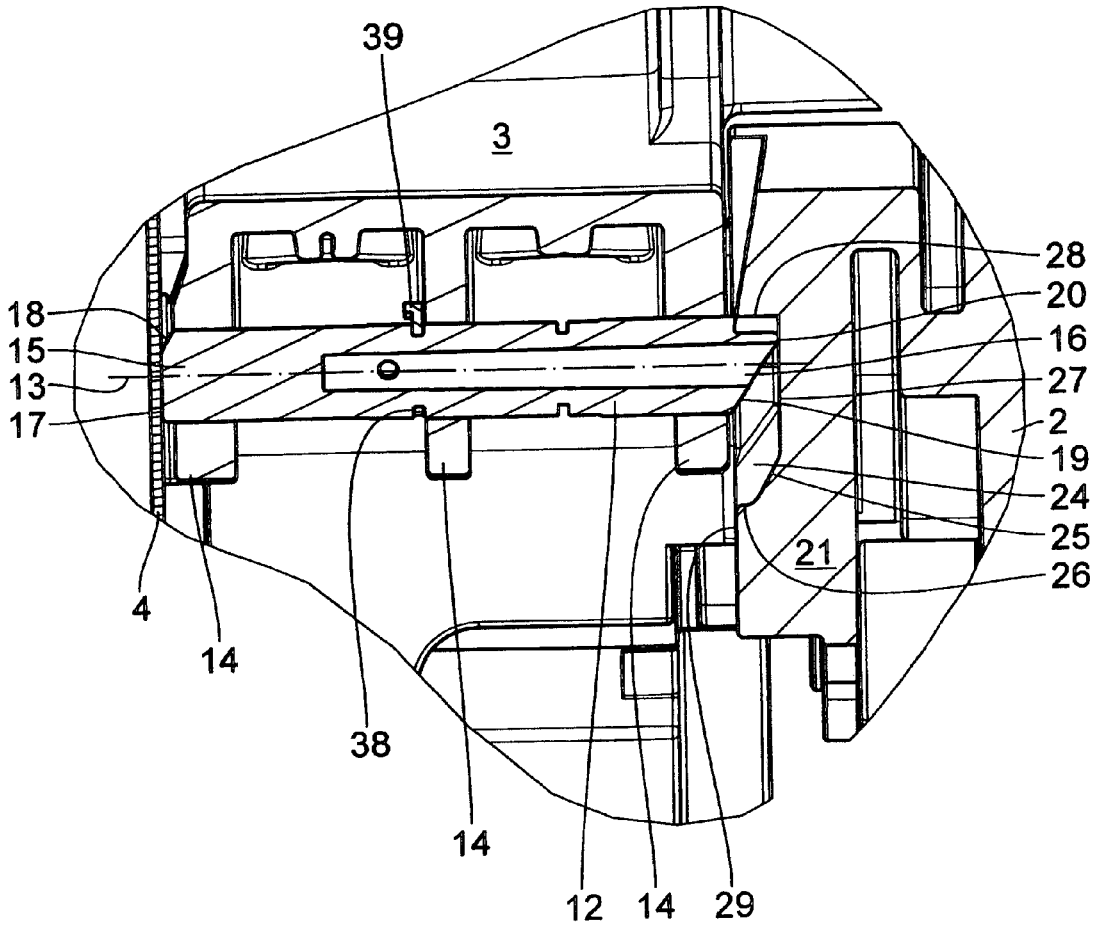
FIG. 2 shows an enlarged detail of FIG. 1 there marked with "A"
Figure 3:
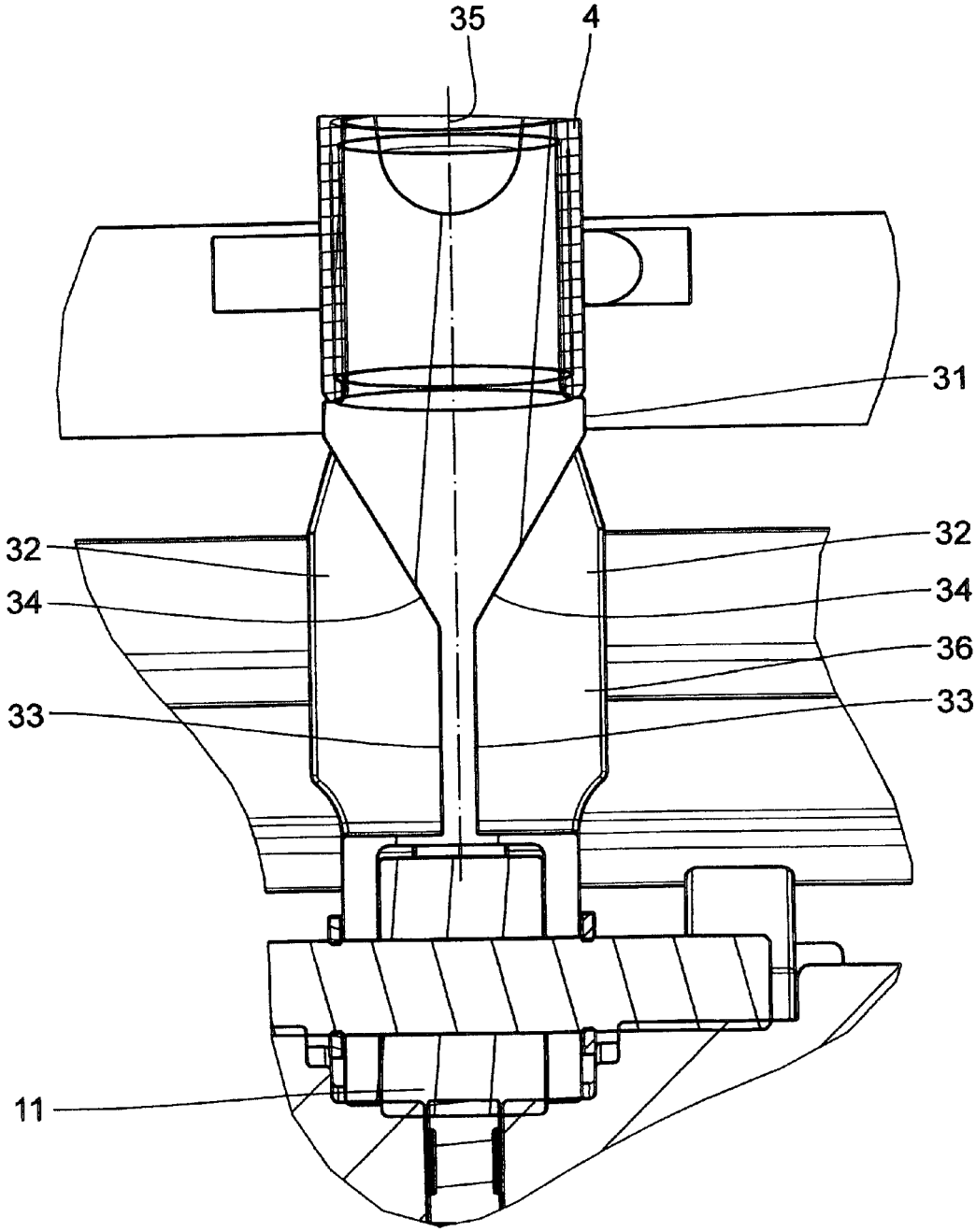
FIG. 3 shows an enlarged detail of FIG. 1 there marked with "B".

A bath tub lifter shown in FIG. 1 as a whole comprises a floor frame 1 to be placed onto the floor of a bath tub (not shown), a seat plate 2 and a backrest 3 being in pivotable connection with the same. The seat plate 2 provides a plane seat for a person to be bathed, while the backrest 3 provides a plane backrest for this person to lean against. For adjusting the height of the seat plate 2 and the backrest 3, the bath tub lifter comprises a controllable lifting means. The lifting means comprises a telescopic lifting tube 4 and a driving means 5 for actuating the lifting tube 4. The lifting tube 4 is in contact with the floor frame 1 and the backrest 3.

The floor frame 1 has an essentially rectangular basic shape. Suction feet 6 are provided at the bottom of the floor frame 1, i.e. on the side opposite a bath tub bottom when the lifter is used according to its purpose. They serve for securely positioning the floor frame 1 in a bath tub and for supporting the floor frame 1 against a bath tub bottom. In the back area of the floor frame 1, two spaced bearing nose pairs 7 are provided in which lower ends 8 of supports 9 are pivotably supported. The upper ends of the supports 9 are hinged at the front bottom of the seat plate 2. In the front area of the floor frame 1, two further supports 10 are pivotably supported which are hinged at the seat plate 2 at the rear bottom. Supports 9, 10 form lift scissors. In the middle between the bearing nose pairs 7, a bearing means 11 for supporting the lifting tube 4 is provided.

On the backside of the backrest 3, the driving means 5 of the lifting means is mounted. In one exemplary embodiment the driving means 5 is an electromotor and can be actuated by a corresponding operating device, for example by a user of the bath tub lifter or a nurse. The driving means 5 is in connection with the lifting tube 4 so as to transmit torque. For lifting or lowering the seat plate 2 and the backrest 3, an internal tube or internal tubes of the lifting tube 4 are extended or retracted, respectively. This extending or retracting motion is achieved by the driving means 5.

For connecting the backrest 3 with the seat plate 2, two identically designed lock bolts 12 are provided which essentially have a round external shape. Each lock bolt 12 comprises a central longitudinal axis 13 and is held at the backrest 3 to be axially movable. To this end, corresponding bearing noses 14 are formed at the backside of the backrest 3. Preferably, the bearing noses 14 comprise closed openings adapted to the external form of the lock bolts 12 which intersperse the lock bolts 12. This results in a guide of the lock bolts 12 along their central longitudinal axis 13. The two lock bolts 12 are aligned, but spaced. They are arranged to extend horizontally and are perpendicular to the lifting tube 4.

Each lock bolt 12 comprises two opposite ends 15, 16. The internal ends 15 of the two lock bolts 12 adjoin the outside of the round lifting tube 4 in the position of the seat plate 2 and the backrest 3 shown in FIG. 1. They face each other. Each internal end 15 is formed by a lower straight contact surface 17 and an upper inclined surface 18. The contact surface 17, which can also be adapted to the bend of the lifting tube 4, here extends at right angles with respect to the longitudinal central axis 13, while the inclined surface 18 extends diagonally to the central longitudinal axis 13. Starting from the contact surfaces 17, the lock bolts 12 extend in the area of their corresponding inclined surfaces 18. Each external end 16 is formed by a lower inclined surface 19 and an upper contact surface 20. The inclined surface 19 again extends diagonally to the central longitudinal axis 13, while the contact surface 20 again extends at right angles with respect to the central longitudinal axis 13. Starting from the contact surface 20, the lock bolt 12 extends in the area of the inclined surface 19. The projected vertical extension of the inclined surface 19 is about three to four times the vertical extension of the contact surface 20. The function of the surfaces 17 to 20 will be discussed below.

The seat plate 2 comprises an essentially horizontal seat surface facing upwards from which a plurality of vertical webs project downwards. It comprises two inner vertical webs 21 extending in parallel one to another, two central vertical webs 22 extending in parallel one to another, and two outer vertical webs 23 extending in parallel one to another. The vertical webs 21, 22 and 23 also extend in parallel one to another. The two vertical webs 21 can also be integral. In this case, they are connected by a corresponding front connecting web. The vertical webs 22 and 23, too, can correspondingly be integral. At or in each vertical web 21, a sliding guide 24 is provided inside. The seat plate 2 altogether has two identical segment-shaped sliding guides 24. The groove-like sliding guides 24 opened to the inside are each formed by a lower stop section 26, a transfer section 25, a stop section 27, and an upper support section 28. The stop section 27 extends vertically while the transfer section 25 adjoining at the bottom of the stop section 27 extends diagonally outwards towards the horizontal stop section 26. The stop section 26 ends at an internal wall 29 of the corresponding vertical web 21. The support section 28 at the top borders on the stop section 27 and extends vertically to the same. The bend of the projecting support section 28 essentially corresponds to the bend of a lock bolt 12 in the area of its external end 16. The distance of a stop section 27 to the corresponding internal wall 29 approximately corresponds to the projected horizontal extension of the inclined surface 19. Equally, the inclination of the inclined surface 19 and the transfer section 25 are essentially identical. The sliding guides 24 are deepest in the area of the stop sections 27. Two outer side flaps 30 are hinged laterally off the seat plate 2.

A spindle base 31 is connected to the lower end of the lifting tube 4. The same is in separable articulated connection with the bearing device 11 of the floor frame 1 and there supports the lifting tube 4. The spindle base 31 has a symmetric shape. It comprises two opposite guide recesses 32 each of which expands downwards. Each guide recess 32 comprises a lower straight release section 33 and an inclined section 34 adjoining the same. The release sections 33 of the two guide recesses 32 extend in parallel one to another and extend in the direction of the central longitudinal axis 35 of the lifting tube 4. They are staggered inwards with respect to the round casing of the lifting tube 4, i.e. towards each other. The inclined sections 34 extend from the release sections 33 upwards and outwards, i.e. away from each other—and end at the bottom of the casing of the lifting tube 4. They are located in the area of the lifting tube 4 where the diameter of the same is largest. The horizontal width of the release and inclined sections 33, 34 approximately corresponds to the horizontal width of the contact surfaces 17 of the lock bolts 12. The inclination of the inclined sections 34 approximately corresponds to the inclination of the inclined surfaces 18. The guide recesses 32 are open to the outside and limited by a guide wall 36 at one side.

Below, the function of the bath tub lifter according to the invention will be described more in detail. The lifting tube 4, the outer tube of which is mounted to the backside of the backrest 3 by means of fastening elements 37, can be extended or retracted, respectively, by the actuated driving means 5. Thereby, the height of the seat plate 2 and the backrest 3 can be adjusted as desired. The lift scissors formed by the supports 9, 10 provide a guide.

According to FIG. 1, the seat plate 2 and the backrest 3 are in their uppermost end position. That means, the seat plate 2 and the backrest 3 have been driven upwards. The lock bolts 12 adjoin the outside of the casing of the lifting tube 4 with their contact surfaces 17 lying opposite. This contact is achieved by the sliding guides 24. One sliding guide 24 is allocated to each lock bolt 12. The lock bolts 12 simultaneously adjoin the stop sections 27 of the sliding guides 24 with their contact surfaces 20. That means, the lock bolts 12 engage the seat plate 2 via the sliding guides 24. In the process, the end sections of the two lock bolts 12 adjoining the contact surfaces 20 contact the support sections 28 of the sliding guides 24, whereby the seat plate 2 and the backrest 3 are coupled to each other.

In case of an adjustment of the height of the seat plate 2 and the backrest 3, the contact surfaces 17 move along the lifting tube 4 on its casing. Moreover, the contact surfaces 20 adjoin the contact sections 27.

When the seat plate 2 and the backrest 3 are lowered from the position shown in FIG. 1 to the lowermost end position, the lock bolts 12 reach the area of the spindle base 31. At the spindle base 31, the contact of the contact surfaces 17 at the lifting tube 4 ends. The contact surfaces 17 of the lock bolts 12 are here pressed into the guide recesses 32 of the spindle base 31 by the transfer sections 25 of the sliding guides 24. The transfer sections 25 are designed in such a manner that the contact surfaces 17 always follow the contours of the guide recesses 32. With the transfer sections 25 and the inclined sections 34 representing a connection between the casing of the lifting tube 4 and the release sections 33, the two lock bolts 12 are gradually moved towards each other. In the lower area of the release sections 33, the lock bolts 12 then adjoin the stop sections 26. A further movement is not possible due to the stop sections 26. In this position, the backrest 3 can be removed from the seat plate 2. The guide wall 36 provides a secure guide of the lock bolts 12 in the guide recesses 32. The inclined surfaces 19 permit a particularly good guide of the lock bolts 12 along the transfer sections 25.

If the seat plate 2 and the backrest 3 are driven upwards again from this lowermost end position, the lock bolts 12 are moved away from one another in the opposite direction by the inclined sections 34 of the spindle base 31 and the inclined surfaces 19 of the sliding guides 24, resulting in a coupling of the seat plate 2 to the backrest 3. In the process, the inclined surfaces 18 provide for the lock bolts 12 being able to trouble-free slide along the inclined sections 34. The inclined surfaces 19 also serve for lock bolts 12, which are possibly not totally shifted back, to be shifted back to their extreme end position when the backrest 3 is erected.

That means the locking between seat plate 2 and backrest 3 is controlled by the normal motion course of the seat plate 2 and the backrest 3. In the process, the locking is automatically effected when the seat plate 2 and the backrest 3 are driven upwards from their lowermost end position. When they are lowered into the lowermost end position, this locking is automatically released. Accordingly, there is a forced control by the sliding guides 24.

Each of the lock bolts 12 comprises an annular groove 38 in each of which a securing ring 39 is received. In the position of the lock bolts 12 which is shown in FIG. 1, the securing rings 39 adjoin the central bearing noses 14. The securing rings 39 prevent the lock bolts 12, which can be loosely axially moved, from getting lost.

The bath tub lifter according to the invention is characterized by a particularly low number of components. Moreover, the actuation of the lock bolts 12 is nearly noiseless.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A bath tub lifter for seniors or disabled persons for use with a bath tub, comprising:

a frame to rest on a portion of the bath tub;

a seat plate and a backrest in connection therewith;

a lifting means for adjusting the height of the seat plate and the backrest between a lowermost and an uppermost end position, the lifting means comprising:

a driving means mounted to the backrest, and a telescopic lifting tube to be actuated by the driving means;

a spindle base in connection with the lifting tube for providing support against the frame; and an automatic lock-release device coupling the backrest and the seat plate above the lowermost end position and releasing the backrest from the seat plate in the lowermost end position such that the backrest is readily removable from the seat plate, the lock-release device comprising:

at least one lock bolt movably held at the backrest for coupling the backrest and the seat plate above the lowermost end position, and at least one sliding guide formed at the seat plate for actuating the at least one lock bolt.

2. The bath tub lifter according to claim 1, wherein the at least one lock bolt is movable between a release position and a lock position.

3. The bath tub lifter according to claim 1, wherein the at least one sliding guide comprises a support section for coupling the backrest and the seat plate.

4. The bath tub lifter according to claim 1, wherein the at least one sliding guide comprises a transfer section for actuating the at least one lock bolt.

5. The bath tub lifter according to claim 4, wherein the transfer section extends diagonally with respect to a vertical line.

6. The bath tub lifter according to claim 1, wherein the at least one lock bolt comprises a central longitudinal axis.

7. The bath tub lifter according to claim 6, wherein the at least one lock bolt comprises an end cooperating with the at least one sliding guide, this end comprising an inclined surface extending diagonally with respect to the central longitudinal axis, and a contact surface extending substantially perpendicularly to the central longitudinal axis.

8. The bath tub lifter according to claim 1, wherein a radially projecting securing element is in connection with the at least one lock bolt.

9. The bath tub lifter according to claim 1, wherein the frame is a floor frame and the floor frame rests on a floor portion of the bath tub.

10. A lock-release device for a bath tub lifter for seniors or disabled persons, the lock-release device comprising at least one lock bolt that is movable between:

i) a lock position for coupling a backrest and a seat plate of a bath tub lifter, and ii) a release position for releasing the backrest and the seat plate from one another such that the backrest is readily removable from the seat plate, the at least one lock bolt being automatically actuated by means of a sliding guide.

* * * * *